United States Patent [19]

Nagase

[11] 4,350,721

[45] Sep. 21, 1982

[54] COLLAPSIBLE INDOOR SPORTS MATS

[75] Inventor: Jiro Nagase, Tokyo, Japan

[73] Assignee: Nagase Rubber Co., Ltd., Tokyo, Japan

[21] Appl. No.: 322,222

[22] Filed: Nov. 17, 1981

[51] Int. Cl.[3] ..... D04H 11/00

[52] U.S. Cl. ..... 428/33; 5/420; 24/205.16 R; 160/DIG. 18; 272/109; 428/304.4

[58] Field of Search ..... 428/17, 33, 52, 58, 428/62, 71, 86, 95, 304.4, 102; 273/1 R, 195; 272/109; 160/DIG. 18; 5/420; 24/205 R, 205.1 C, 205.16 R

[56] References Cited

U.S. PATENT DOCUMENTS

| | | | |
|---|---|---|---|
| 2,511,414 | 6/1950 | Poux | 24/205.16 R |
| 3,906,129 | 9/1975 | Damois | 428/52 |
| 4,042,735 | 8/1977 | Koneya | 428/62 |
| 4,137,583 | 2/1979 | Baldwin et al. | 272/109 |
| 4,137,683 | 2/1979 | Pfeiffer | 160/DIG. 18 |
| 4,160,306 | 7/1979 | Pizzoccaro | 24/205.16 R |

*Primary Examiner*—William J. Van Balen

*Attorney, Agent, or Firm*—Holman & Stern

[57] ABSTRACT

In a collapsible indoor sports mats in which a plurality of unit mats can be connected to and separated from one another by means of fasteners, the improvement wherein tapes of the fasteners having engaging teeth aligned thereon are fixed on the backs of the connecting edges of the unit mats, non-toothed portions for guiding a slider are formed by removing the engaging teeth, at the ends of extending parts extending from the unit mats, and location reference line marks are put at corresponding positions on the surface of the extending parts opposing one another, so that court lines on the unit mats to be connected are automatically matched with one another.

3 Claims, 5 Drawing Figures

COLLAPSIBLE INDOOR SPORTS MATS

BACKGROUND OF THE INVENTION

This invention relates principally to indoor sports mats that are connected to one another by fasteners when used, and separated for storage or transporting.

The mats of this kind are generally composed of a plurality of long unit mats that are to be connected by fasteners for use. The tape of each fastener is equipped with a part, about 10 cm long, extending from the end of each mat, from which part a slider is inserted to engage with the tapes. However, since the extending part of the conventional tape merely protrudes beyond the mat, it is by no means easy to accurately match the right and left tapes and to insert the slider from them, so that the unit mats and lines put on their surfaces are likely to deviate from one another, detracting from the mat appearance. Moreover, connection or assembly of these unit mats is too time consuming.

SUMMARY OF THE INVENTION

The present invention is therefore directed to provide indoor sports mats equipped with fasteners that eliminate the problems with the prior art, and make it possible to easily and accurately insert the sliders in place and to automatically align the court lines.

DESCRIPTION OF THE PREFERRED EMBODIMENT

Figure 1:
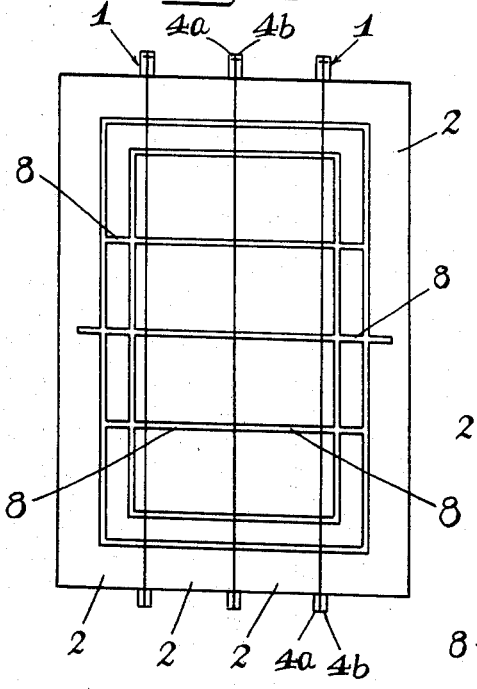
FIG. 1 is a plan view of collapsible indoor sports mats in accordance with an embodiment of the present invention.
Figure 2:
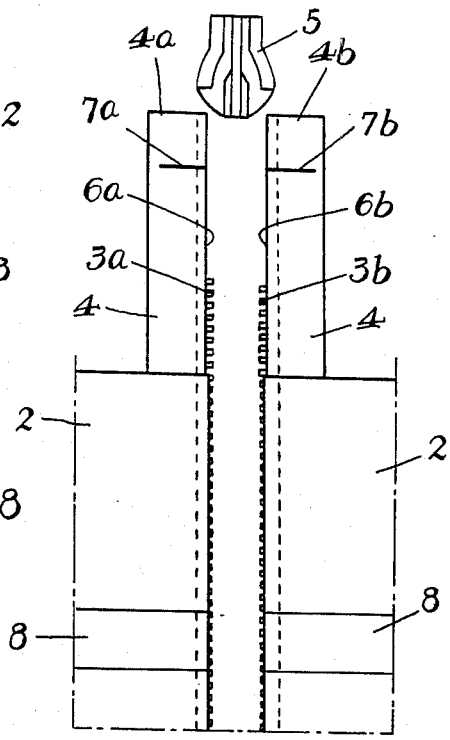
FIG. 2 is a plan view showing the separated state of the sports mats.
Figure 3:
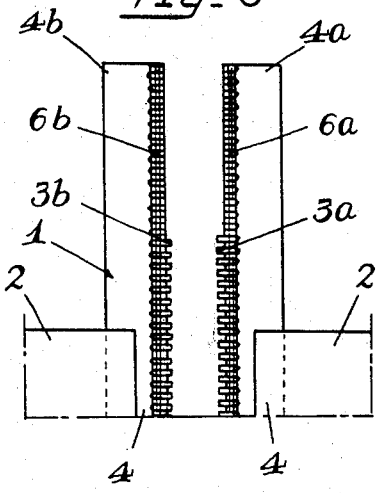
FIG. 3 is a rear view of FIG. 2.
Figure 4:
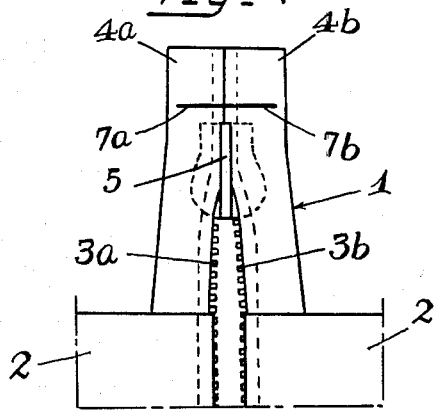
FIG. 4 is a plan view showing the state in which a slider is made to engage with engaging teeth of a fastener.
Figure 5:
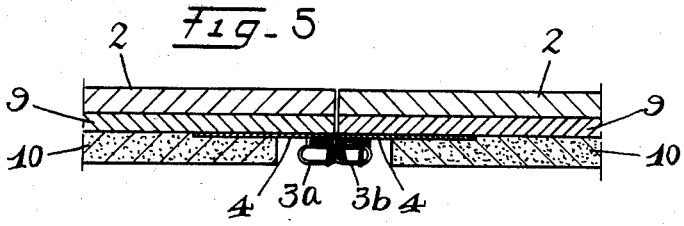
FIG. 5 is a cross section of FIG. 1.

In collapsible sports mats in which a plurality of unit mats 2, 2 can be connected and separated by use of fasteners 1, the present invention is characterized by the construction described below. Namely, tapes *4a*,*4b* equipped with aligned engaging teeth *3a*, *3b* for the fastener 1 are fixed on the back of the connection ends of the unit mats 2, 2, non-toothed portions *6a*, *6b* for guiding a slider 5 that are formed by removing the engaging teeth *3a*, *3b* are disposed at the end portions of extending parts that protrude from the unit mats 2, 2, and location reference line marks *7a*, *7b* are put at corresponding positions on the surfaces of the extending parts *4a*, *4b* opposing one another so that court lines 8, 8 of the adjacent unit mats 2, 2 to be connected are automatically aligned with each other.

In the present invention, the non-toothed portions *6a*, *6b* not equipped with the engaging teeth *3a*, *3b* are formed on the extending parts *4a*, *4b*, as described above, so that the slider 5 can be inserted from these non-toothed portions. Moreover, since the reference line marks *7a*, *7b* are put on the surfaces of the non-toothed portions, these reference line marks *7a*, *7b* can first be matched with one another and the slider 5 then inserted from one of the tapes *4a*,*4b* onto the other between the non-toothed portions *6a*,*6b*. According to this construction, the slider 5 can accurately be guided and the engaging teeth *3a*,*3b* will always engage with each other at the correct position. Consequently, the unit mats 2, 2 can be connected to one another easily and rapidly without any problems, in particular the court lines 8, 8 on the unit mats 2, 2 will match with each other accurately. These unit mats can be easily and smoothly separated at the non-toothed portions *6a*, *6b* without any problems.

Further it is necessary to take up space longer than a length of the slider 5 between the engaging teeth *3a*, *3b*and the location reference line marks *7a*, *7b* so that the reference line marks *7a*, *7b* may be matched freely by the hands while the slider 5 is located between the engaging teeth *3a*, *3b* and the location reference line marks *7a*, *7b*.

Furthermore linings 9, 9 are adhered to the unit mats 2, 2 and elastic plates 10, 10 of sponge materials are also adhered to the linings 9, 9. The elastic plates 10, 10 of sponge materials are made of foam rubber or plastic foam of polyvinyl chloride, polyurethane or polystyrene etc. The elastic plates 10, 10 have enough space to let the slider 5 move freely between themselves. The linings 9,9 are preferably made of glass fiber.

What is claimed is:

1. In collapsible indoor sports mats in which a plurality of unit mats can be connected to and separated from one another by means of fasteners, the improvement wherein tapes of said fasteners having engaging teeth aligned thereon are fixed on the backs of said unit mats at their connecting edges, non-toothed portions for guiding a slider formed by removing said engaging teeth are formed at the ends of parts extending from said unit mats and location reference line marks are put at the corresponding positions on the surface of said extending parts opposing one another so that court lines on said unit mats to be connected are automatically matched with one another.

2. The combination as recited in claim 1 wherein spaces between said engaging teeth and said location reference line marks are longer than a length of said slider.

3. The combination as recited in claim 1 wherein linings are adhered to said unit mats and elastic plates of sponge materials are also adhered to said linings, said elastic plates of sponge materials having enough space to let said slider move freely between themselves.

* * * * *